US005947200A

United States Patent [19]

Montgomery

[11] Patent Number: 5,947,200

[45] Date of Patent: Sep. 7, 1999

[54] METHOD FOR FRACTURING DIFFERENT ZONES FROM A SINGLE WELLBORE

[75] Inventor: Carl T. Montgomery, Plano, Tex.

[73] Assignee: Atlantic Richfield Company, Los Angeles, Calif.

[21] Appl. No.: 08/936,908

[22] Filed: Sep. 25, 1997

[51] Int. Cl.[6] ..... E21B 43/26

[52] U.S. Cl. ..... 166/281; 166/308; 166/305.1

[58] Field of Search ..... 166/51, 308, 387, 166/281, 305.1, 306

[56] References Cited

U.S. PATENT DOCUMENTS

| | | | |
|---|---|---|---|
| 3,598,183 | 8/1971 | Scott | 166/387 X |
| 4,484,625 | 11/1984 | Barbee, Jr. | 166/185 |
| 5,056,598 | 10/1991 | Jennings, Jr. | 166/308 |
| 5,330,003 | 7/1994 | Bullick | 166/51 X |
| 5,396,957 | 3/1995 | Surjaatmadja et al. | 166/308 |
| 5,400,856 | 3/1995 | Schmidt | 166/308 X |
| 5,409,061 | 4/1995 | Bullick | 166/51 X |
| 5,443,122 | 8/1995 | Saucier | 166/51 X |
| 5,492,175 | 2/1996 | El-Rabaa et al. | 166/308 X |

*Primary Examiner*—Frank Tsay
*Attorney, Agent, or Firm*—Drude Faulconer

[57] ABSTRACT

A method for fracturing a plurality of different subterranean production zones which are spaced along a wellbore wherein flow is established into a first or lower zone while a removable sleeve blocks flow into the other upper zones. The first zone is fractured and the sleeve is then notched, preforated, or repositioned to establish flow into a second zone while flow is now blocked into the lower, fractured zone. The second zone is fractured and this procedure is repeated until all of the desired zones have been fractured after the sleeve is retrieved to the surface.

16 Claims, 4 Drawing Sheets

METHOD FOR FRACTURING DIFFERENT ZONES FROM A SINGLE WELLBORE

DESCRIPTION

1. Technical Field

The present invention relates to a method for fracturing different zones from a single wellbore and in one aspect relates to a method for fracturing a plurality of different subterranean production zones which are spaced along a wellbore wherein a removable sleeve is used to block flow into the upper zones while the lower zone is fractured. The sleeve is then notched, preforated, or repositioned to fracture an upper zone. This procedure is repeated until all of the desired zones have been fractured.

2. Background Art

In drilling and completing wells for the production of hydrocarbons or the like, it is not uncommon for a single wellbore to pass through a plurality of subterranean production zones. These zones, which are spaced from each other along the wellbore, might all lie within a single formation or each might lie within a separate and distinct formation as will be understood in the art. There are several known techniques for completing such wellbores so that all of the production zones can be produced through a single wellbore.

For example, it is conventional to case and cement the wellbore substantially throughout its length and then perforate the casing adjacent each of the production zones to allow the fluids from each of the zones to flow into the casing and be produced to the surface. In another conventional completion, the wellbore is cased only to a depth which lies above the uppermost production zone and the zones are produced either (a) "open hole" or (b) through a "slotted liner" or the like which is hung from the lower end of the casing.

When completing a well with such conventional techniques, it is not uncommon to also "gravel pack" that portion of the wellbore which lies along the production zones in order to control the production of particulate material (e.g. sand) into the wellbore. Typically, this is done by positioning a well screen (e.g. slotted liner) through the production zones and then filling the annulus around the screen with "gravel" which, in turn, filters out produced sand from the production fluids while allowing the fluids to flow into the screen.

Further, it is common to "hydraulically fracture" certain production zones to improve the production therefrom. A production zone(s) may be fractured before a well is put on production or the fracturing operation may be carried later in the life of a well when the initial production rate of the well has significantly declined. In a typical hydraulic fracturing operation, a flowstring is lowered into the wellbore and positioned adjacent the subterranean formation or interval to be fractured. A fracturing fluid is pumped through the flowstring and into the fracture interval at a pressure high enough to cause the bedding planes in the formation to separate or "fracture". Normally, the fracturing fluid carries a proppant material (e.g. sand) suspended therein which is deposited into the fracture as it is being formed to thereby "prop" the fracture open once the fracturing pressure is relaxed.

If the fracture interval is substantially homogenious throughout its "thickness" (i.e. an interval having substantially the same permeability and/or breakdown pressure throughout), conventional fracturing techniques usually produce a good distribution of fracture(s) through the interval.

However, where a fracture interval may be heterogenious (i.e. include two or more spaced zones which have substantially different break-down pressures), conventional fracturing techniques are likely to produce less than desirable results. Such heterogenious intervals may be those comprised of (a) a plurality of spaced zones lying in a layered reservoir; (b) reservoirs penetrated by inclined and/or horizontal wellbores; (c) extremely thick producing formations; (d) reservoirs comprised of several proximate production zones separated by thin, impermeable layers, and etc.

As is well known in the art, it is extremely difficult, if practical at all, to fracture a plurality of spaced zones within a single wellbore in a single operation, especially where such zones lie in close proximity to each other. This difficulty arises from the fact that the zone having the lowest break-down pressure will normally begin to fracture first. Once a fracture has been initated in this first zone, it becomes almost impossible to initiate a fracture in a second zone (i.e. one having a higher break-down pressure) lying along the single wellbore.

That is, substantially all of the fracturing fluid will continue to flow into the initial fracture to enlarge the fracture with little, or no fracturing fluid flowing to the other zones. Further, it is not uncommon for the fracturing fluid to prematurely lose liquid into the initial fracture or into the more permeable zones along the wellbore thereby causing proppants to settle out of the fracturing fluid and form a "sand bridge(s)" adjacent the initial fracture which, in turn, blocks further flow of fracturing fluid to the other zones in the wellbore. This results in a poor distribution of fractures throughout the fracture interval since normally only the zone having the lowest break-down pressure can be effectively fractured.

SUMMARY OF THE INVENTION

The present invention provides a method for fracturing different subterranean production zones which are space along a wellbore which, in turn, may be a vertical wellbore or a horizontal wellbore. Basically, the "upper" zones are isolated while a first or lower zone is fractured. Fluid communication is then established to a second or upper zone while flow is blocked to the first zone after the first zone has been fractured. The second zone is then fractured and the method is continued until all of the zones within the wellbore are fractured.

More specifically, the present invention provides a method for fracturing a lower production zone and at least one upper subterranean zone which are spaced along from each other a single wellbore. A sleeve is lowered into the wellbore to block flow to the upper zone(s) while a first flow passage is established to the lower zone. A fracturing slurry having proppants therein is flowed under fracturing pressure through the first flow passage to fracture the lower zone. The first fluid passage is preferably established by positioning the sleeve so that the lower end of the sleeve lies above said lower zone when the sleeve is in its first operable position within said wellbore.

Next, a second flow passage is established to an upper zone within the wellbore. This may be accomplished in the following ways: (a) by raising the sleeve within the wellbore and repositioning it so that the lower end of the sleeve will lie above the upper zone when the sleeve is in its second operable position within said wellbore; (b) by retrieving the sleeve to the surface, shortening its length so that the lower end of the shortened sleeve will lie above the upper zone when the sleeve is in its second operable position within said wellbore; and then lowering the shortened sleeve to said second operable position; or (c) by cutting a notch in situ through the sleeve or by perforating the sleeve adjacent the one upper zone.

Flow is blocked through said first flow passage after said lower zone has been fractured and fracturing slurry is flowed through the second flow passage to thereby fracture the upper zone. The first flow passage is blocked by placing a column of loose, particulate material in said wellbore which extends above said first flow passage. These steps are repeated until all of the zones have been fractured. The sleeve and the particulate material is then removed from the wellbore and the well is put on production.

The present method can be carried out in a cased wellbore, an open-hole wellbore, an open-hole/slotted liner wellbore, and/or a gravel-packed wellbore. In such completions, the outer diameter of the sleeve is to be at least 80% of the inner diameter of said respective wellbore in order to produce an annulus between the sleeve and the respective wellbore in which proppants will "sand out" and thereby block any substantial flow of fracturing fluid through the annulus during the fracturing operation.

BRIEF DESCRIPTION OF THE DRAWINGS

The actual construction, operation, and apparent advantages of the present invention will be better understood by referring to the drawings which are necessarily to scale and in which like numerals refer to like parts and in which.

BEST KNOWN MODE FOR CARRYING OUT INVENTION

Figure 1:
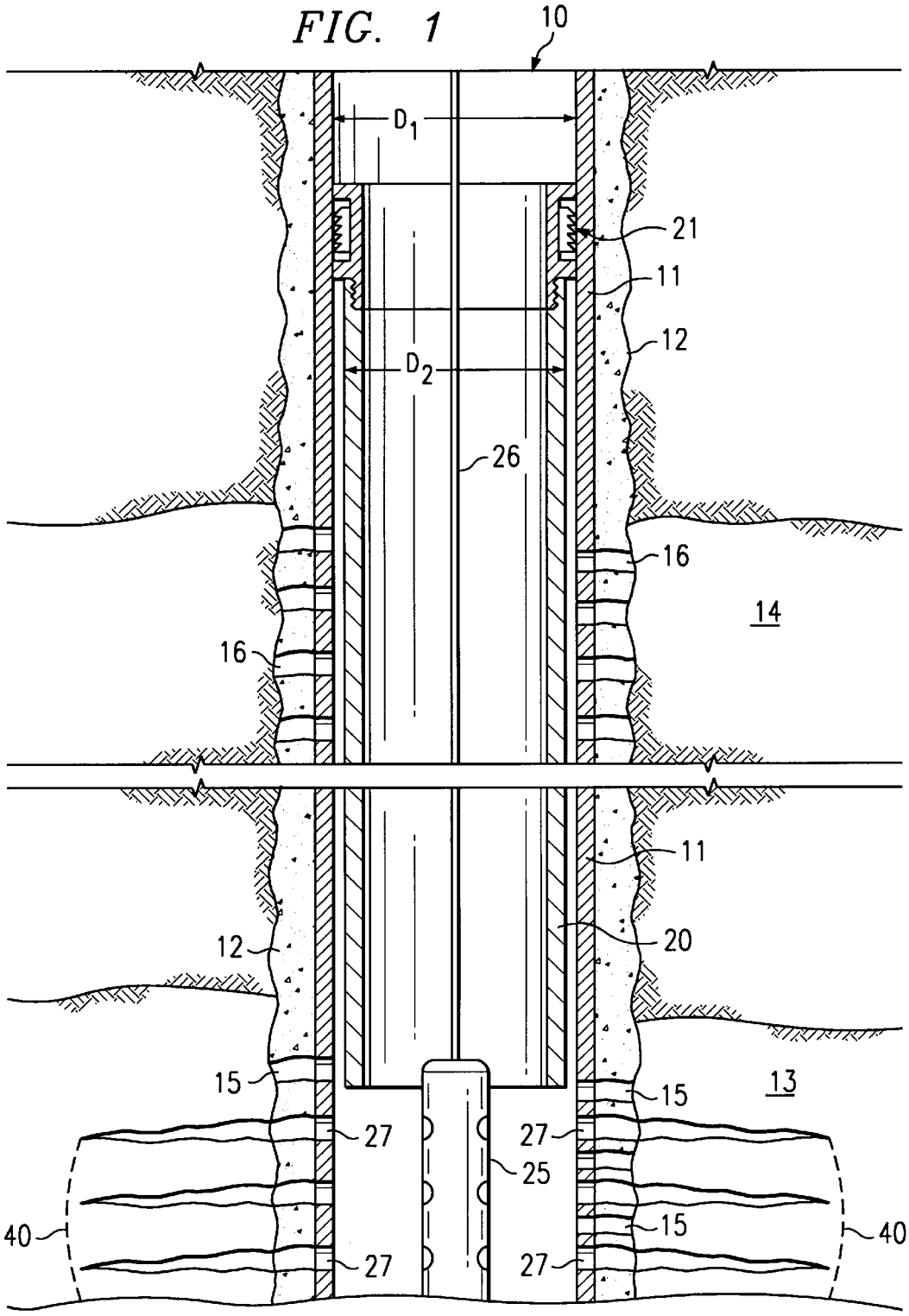
FIG. 1 is an sectional view of the lower end of a cased wellbore in which a first step of the present fracturing method is being carried out.

Referring more particularly to the drawings, FIG. 1 illustrates the lower end of a wellbore 10 which passes through a two or more production zones (only two shown, e.g. formations 13 and 14). While a lower production zone 13 and at least one upper production zone 14 have been illustrated as lying in separate formations, it should be understood that the term "zone" or "zones", as used herein, may also include zones having different break-down pressures and/or permeabilities which are spaced from each other within the same formation. Wellbore 10, as shown, has been cased substantially throughout its length with casing 11 which, in turn, has been cemented in the wellbore with cement 12, as will be understood in the art.

While wellbore 10 is illustrated as being a substantially vertical wellbore, it should be further understood that the present invention is equally applicable for use in inclined and/or horizontal wellbores. Accordingly, the terms "upper and lower", "top and bottom", "first and second" etc., as used herein, are intended to be used in their relative sense and are meant to refer to a relative position within a particular wellbore; be that wellbore be vertical, inclined, or horizontal. For example, in a horizontal wellbore, "upper" or "top" means a position within the wellbore which is at a shorter distance from the wellhead than is a "lower" or "bottom" position within the same wellbore.

Fluids (e.g. oil and gas) will flow from production zones 13, 14 into casing 11 through respective perforations 15, 16 and are produced to the surface using conventional techniques. However, as will be understood in the art, when the production rate of the well drops below an acceptable rate, it may become necessary to "treat" the production zones to stimulate and raise production therefrom or the well will likely have to be abandoned. One such treatment is one which is commonly known as "hydraulically fracturing".

To better understand the advantages of the present invention, a brief review of conventional fracturing techniques will be beneficial. That is, in typical, known fracturing operations, the interval to be fractured is isolated and a fracturing fluid (e.g. a gelled slurry having props therein) is flowed at fracturing pressures down the wellbore through a flowstring (not shown) and out through perforations 15, 16 into the respective production zones. If the zones in the fracture interval are relatively homogenious, the fracturing slurry will cause the bedding planes in the zones to separate thereby providing a good distribution of fractures throughout the zone(s).

However, where the fracture interval is heterogenous (i.e. zones 13 and 14 having different break-down pressures and/or relative permeabilities), the zone having the lowest break-down pressure (be it lower zone 13 or upper zone 14) will begin to fracture first under normal fracturing conditions. Once a fracture is initiated in the first zone, substantially all of the fracturing fluid will continue to flow into that fracture thereby preventing the initiation of a fractures in the other production zone(s). Further, it is not uncommon for the fluid in the fracturing slurry to be prematurely lost into the now-fractured, first zone or into the more permeable zones within the fracture interval. When this happens, the props (e.g. sand) settle out of the slurry and form a "sand bridge" within the well annulus which, in turn, blocks any further substantial flow of fracturing fluid to the other production zones.

To avoid these problems, it has been proposed to individually isolate each production zone before fracturing that zone. However, this generally requires that "straddle" packers or the like be positioning and set each time a zone is to be fractured. As will be understood in the art, this is both difficult and time-consuming, especially where the zones to be fractured lie in close proximity to each other (i.e. the zones are closely spaced along the wellbore). Further, this technique may also be risky in some wells in that sand can accumulate in the wellbore above the packers thereby sticking the workstring in the wellbore which, in turn, can seriously jeoparized the well, itself.

Returning now to the present invention, the fracturing of production zones (e.g. closely-spaced zones 13, 14) is carried out by lowering a sleeve in casing 11 to effectively isolate the upper production zone(s) before establishing a first flow passage to a lower production zone before fracturing the lower zone. This first flow passage can be established by cutting a notch in the sleeve or perforating the sleeve adjacent the lower zone, or as shown in FIG. 1, this is accomplished positioning the sleeve 20 within casing 11 so that the lower end of the sleeve lies slightly above or substantially adjacent the upper portion of a first or lower production zone 13.

Sleeve 20 may be constructed of any durable material, e.g. steel pipe, and has length sufficient to extend upward through the upper production zones and terminate at a point which lies above the uppermost production zone in the interval fracture interval when sleeve 20 is in its first operable position within the wellbore.

As will be understood in the art, the upper end of sleeve 20 may be suspended in its first operable position within casing 11 by any known means. For example, the upper end of sleeve 20 may be run in on a running string (not shown) and landed in a landing nipple or collar (not shown) properly positioned in casing 11 or, as illustrated, the sleeve 20 can carry a releasable, hanger 21 at its upper end. Hanger 21 may be of any conventional type commonly available in the industry to support pipe, packers, or the like within a tubular, e.g. slip mechanism 21 which, in turn, can be set and released hydraulically or by manipulating the running string on which sleeve 20 is lowered.

Once sleeve 20 has been properly positioned and suspended within casing 11, the running is released and retrieved to the surface. A conventional perforator 25 (e.g. shaped-charge, perforating "gun") is lowered on operating line 26 (FIG. 1) and is positioned adjacent zone 13 below the lower end of sleeve 20. Perforator 25 is actuated to produce a new set of lower perforations 27 through casing 11, cement 12, and into production zone 13. As will be understood in the art, perforator 25 is oriented using conventional techniques so that perforations 27, when formed, will lie substantially in alignment with and/or parallel with the bedding planes within zone 13; i.e. aligned with the "fracture plane" of the zone.

Preferably, these perforations 27 will extend outward into zone 13 for a distance equal to at least 1.5 times the diameter of the original wellbore 10. This allows the perforations 27 to penetrate the "stress cage" (i.e. the compacted area inherently formed around the wellbore by the drilling of the wellbore, itself) and thereby provide good fluid communication through the stress cage and out into zone 13.

A flowstring (e.g. a string of coiled tubing, see 30, FIG. 2) is lowered in casing 11 and through sleeve 20 until the lower end of flowstring 30 will lie below the lower end of sleeve 20. Preferably, a packer 31 (FIG. 2) is carried by flowstring 30 and is set above sleeve 20 (not within sleeve 20) to block flow through casing 11 at that point. An important aspect of the present invention lies in making the outer diameter $D_2$ (FIG. 1) of sleeve 20 equal to at least 80% of the inner diameter $D_1$ of casing 11. It has been found that where the outer diameter of an inner tubular (i.e. sleeve 20) is at least 80% of the inner diameter of an outer tubular (i.e. casing 11), props (e.g. sand) will inherently screen out of a fracturing slurry as the slurry attempts to flow between the tubulars. The inherent "sanding-out" of the props blocks any further flow through this annulus and eliminates the need for seals between the sleeve and the casing which, if used, would make it extremely difficult, if possible at all, to remove the sleeve from the casing when the fracturing operation is concluded.

A fracturing slurry (e.g. a fracturing gel having sand suspended therein) flows down flowstring 30 and out into casing 11 below sleeve 20. Due to the packer 31 and the inherently blocked annulus between sleeve 20 and casing 11, substantially all of the pressurized, fracturing slurry can only flow through the new set of lower perforations 27 and into production zone 13 to initiate and expand a fracture (represented by dotted line 40 in FIG. 1). It should be recognized that fracture 40 will be initiated and expanded in zone 13 regardless of the relative break-down pressures of the zones to be fractured since sleeve 20 effectively blocks the flow of the fracturing slurry to all zones except lower zone 13.

Figure 2:
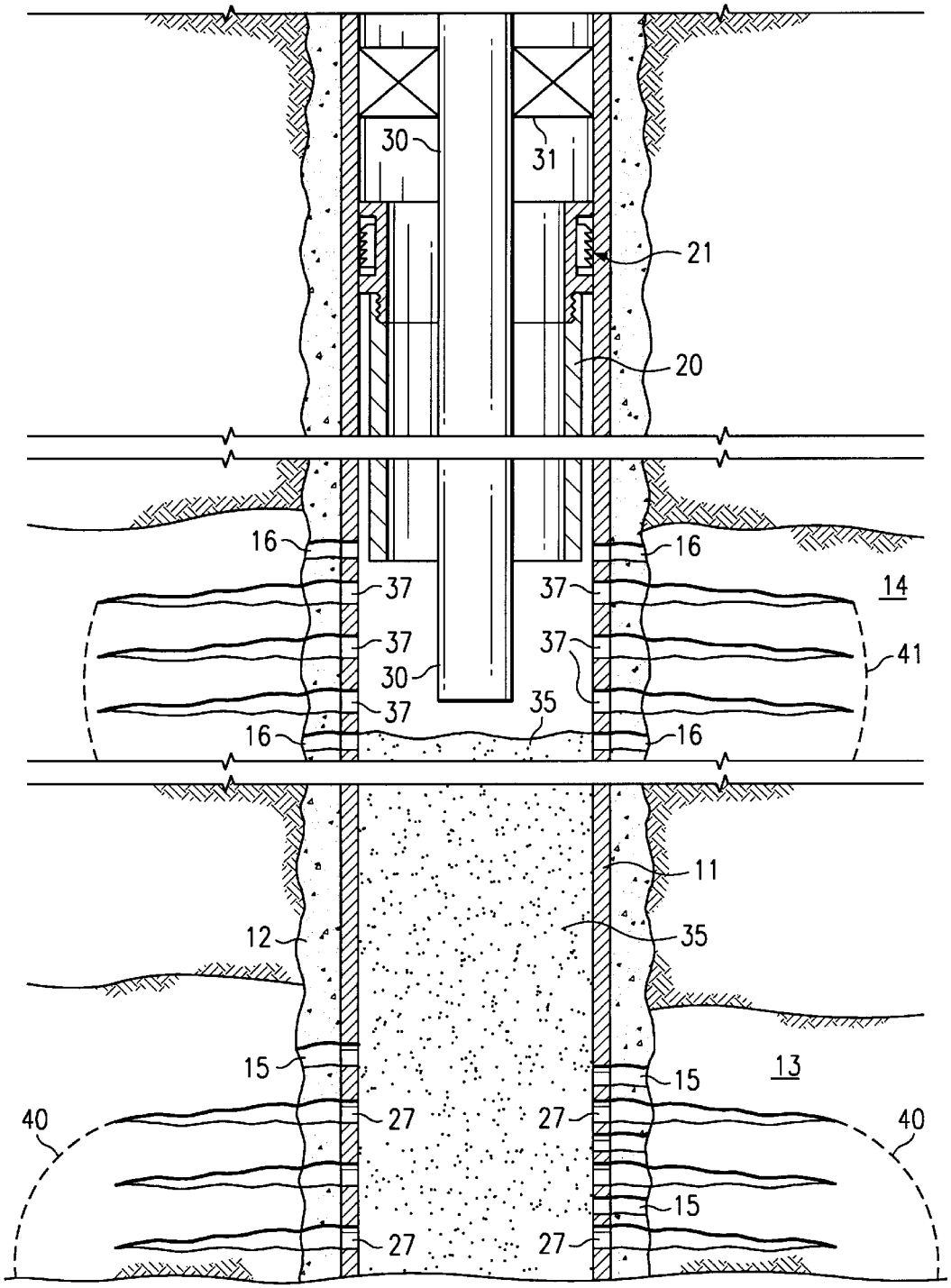
FIG. 2 is a sectional view of the cased wellbore of FIG. 1 wherein a further step of the present fracturing method is being carried out.

After lower production zone 13 has been fractured, flowstring 30 is withdrawn to the surface and a second flow passage is established adjacent the upper zone 14. As shown in FIG. 2, this second flow passage is established by effecting raising the lower end of sleeve 20 to a second operable position within casing 11 wherein the lower end of the sleeve will now be positioned above the upper production zone 14. The effective raising of the lower end of sleeve 20 can be accomplished by any of the following techniques: (a) merely raising sleeve 20 upward in the casing 11, or (b) retrieving the sleeve 20 to the surface, cutting the sleeve to a shorter length, and returning the shortened sleeve to the wellbore To physically raise sleeve 20, a running string (not shown) with a stab-in connector or the like on its lower end is lowered in casing 11 to engage sleeve 20. The running string is then manipulated to release hanger 21 and raise sleeve 20 to its new operable position within casing 11. Hanger 21 is re-set to suspend sleeve 20 within casing 11 with the lower end of sleeve 20 now being above upper zone 14. The running string is released and again retrieved to the surface.

To shorten sleeve 20, the sleeve 20 is retrieved by to the surface on a running string and is cut to its now required length. The shortened sleeve is then again lowered and re-set in its second operable position within the casing in the same manner as before. With either technique of effectively raising the sleeve 20, the lower end of the sleeve will be positioned as shown in FIG. 2 when in the sleeve is in its second operable position within wellbore 11. A column 35 of loose, particulate material, e.g. sand, is supplied into casing 11 to fill same to a level above the lower sets of perforations 15 and 27. This column of sand blocks any substantial flow of fluids through the lower sets of perforations. By using a loose, particulate material such as sand to block the perforations, they can easily be re-opened when the well is put back on production by merely washing the sand back to the surface, as will be understood in the art.

A perforator, similar to perforator 25 in FIG. 1, is lowered through casing 11 and is positioned below the lower end of sleeve 20 and is actuated to form a new set of upper perforations 37. Again, the perforator is oriented with conventional techniques to provide upper perforations 37 which will substantially align with the fracture plane of zone 14 when formed. Also, it is again desirable, if possible, for perforations 37 to extend through the "stress cage" area surrounding the wellbore to aid in the flow of fluids into fracturing zone 14.

Flowstring 30 is then lowered, packer 31 is set, and fracturing slurry is flowed under fracturing pressure down the flowstring 30 and into casing 11 below the lower end of sleeve 20. The fracturing slurry can only flow through the new or second set of upper perforations 37 since packer 31 blocks upward flow through the casing, the column of sand 35 blocks downward flow into zone 13, and as pointed out above, the relative diameters of the tubular (i.e. the outer diameter $D_2$ of sleeve 20 is equal to at least 80% of the inner diameter $D_1$ of casing 11) prevent any substantial flow of slurry therebetween.

The fracturing slurry is forced under pressure through the second set of upper perforations 37 into upper production zone 14 to initiate and expand fracture 41 therein. The above steps are repeated until all of the production zones (only two shown) have been fractured after which sleeve 20 is removed to the surface and the well is again put on production.

Figure 3:
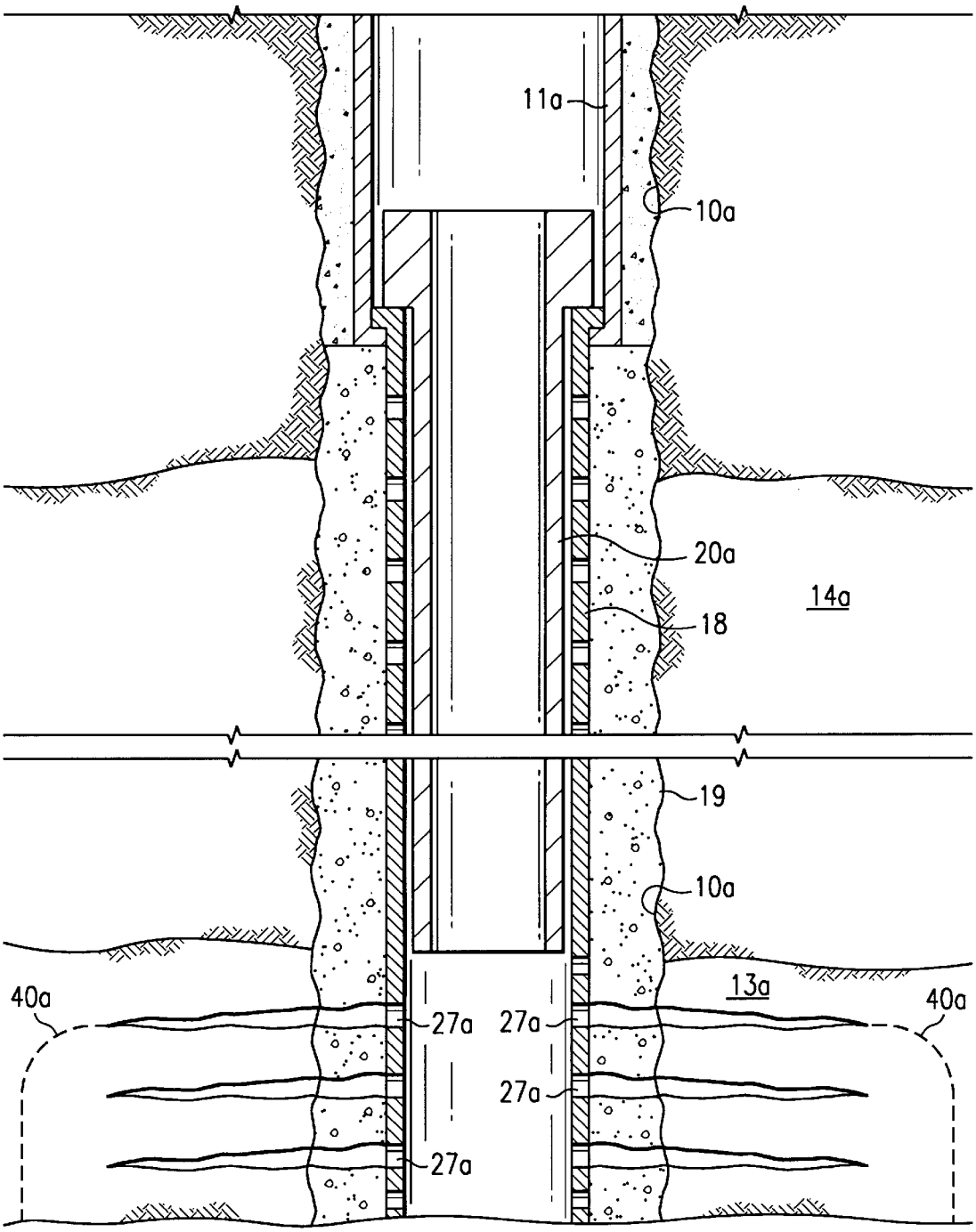
FIG. 3 is a sectional view of the lower end of a gravel-packed wellbore after a first step of the present invention has been carried out.
Figure 4:
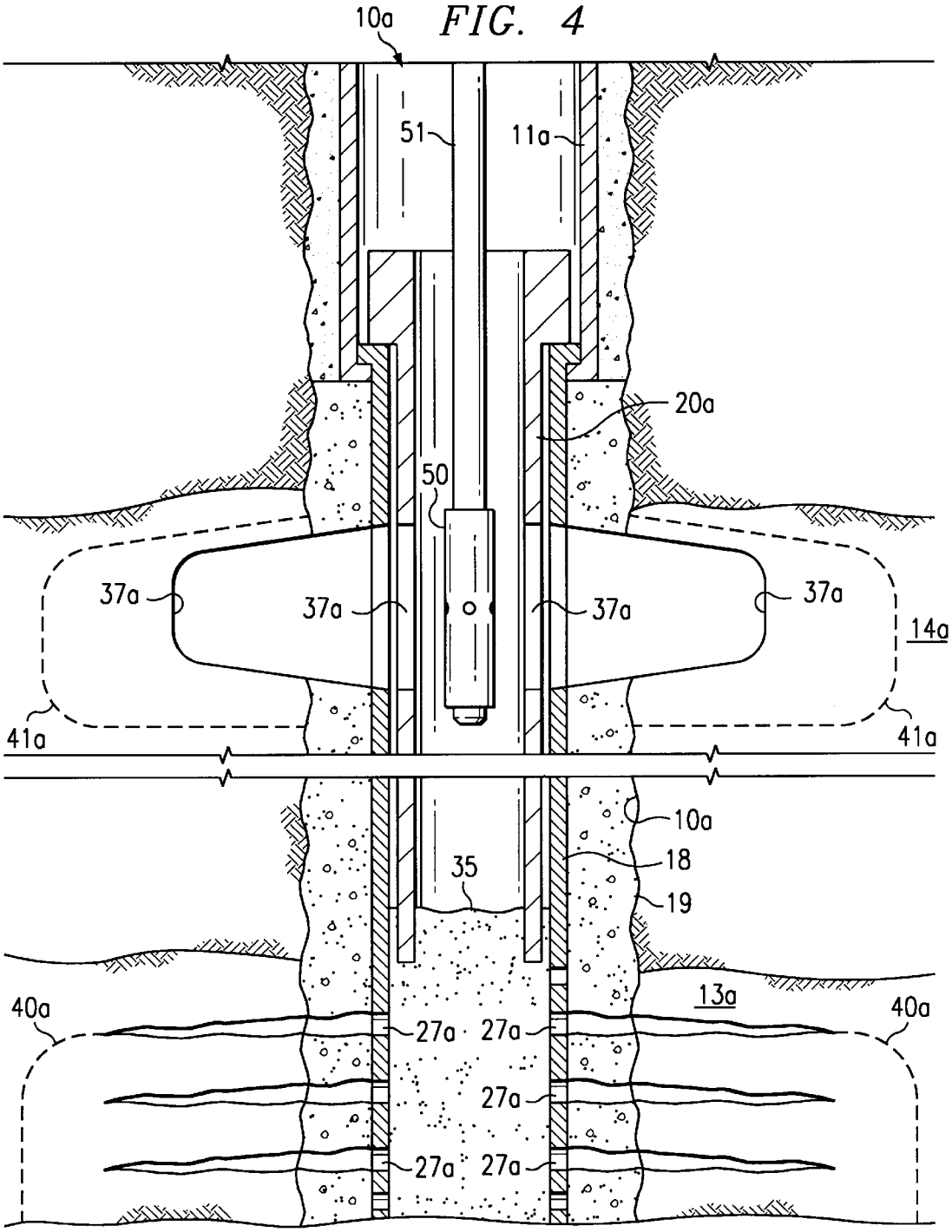
FIG. 4 is a sectional view of the gravel-packed wellbore of FIG. 3 wherein a further step of the present fracturing method is being carried out.

Another embodiment of the present invention is illustrated in FIGS. 3 and 4 wherein the fracturing method of the present invention is carried out in a different type of well completion. In this type of a completion, wellbore 10*a* is not cased throughout its length, but instead, is only cased and cemented to a point which lies above the uppermost production zone 13*a*. As shown, a permeable liner 18 (e.g. slotted liner, well screen, perforated pipe, etc.) is hung from the bottom of casing 11*a* and extends through the production zones. Where the well is to be gravel-packed, as shown, the annulus between wellbore 10*a* and liner 18 is filled with "gravel" 19, as will be understood in the art.

Sleeve 20*a* is lowered on a running string (not shown) and is hung from or otherwise suspended from the upper end of liner 18. As before, the lower end of sleeve 20*a* will lie above the lower production zone when sleeve 20*a* is in its first operable position within liner 18. The outer diameter of sleeve 20*a* is again equal to at least 80% of the inner diameter of liner 18 to prevent any substantial flow of slurry between the sleeve and the liner during fracturing. A perforator (see 25 in FIG. 1) is lowered through sleeve 20*a* and is oriented and actuated to form a first or new set of lower perforations 27*a* through casing 11*a* and gravel pack 19, and out into zone 13*a* in the direction of the fracture plane of zone 13*a*.

A flowstring (see 30 in FIG. 2) is lowered and a packer (see 31 in FIG. 2) is set before a fracturing slurry is pumped down the flowstring and out through the new set of lower perforations 27*a* to initiate and expand fracture 40*a* in zone 13*a*. Where the well has been gravel-packed as illustrated, it is preferred that the fracturing slurry contain a consolidating agent, e.g. a thermal-setting resin such as phenol formaldehyde, which coats the gravel 19 around perforations 27*a* to form a consolidated but permeable mass in and/or around the perforations. This prevents gravel or other particulate material from flowing back through the new set of perforations 27*a* when the well is put back on production.

The lower end of sleeve 20*a* can then be either effectively repositioned as described above to fracture upper production zone 13*a* or alternatively, as shown in FIG. 4, a zone 14*a* can be fractured without moving sleeve 20*a* in its original operable position. To do the latter, the sleeve is left in place and a second flow passage is established in situ through the sleeve 20 and the liner 18 at a point adjacent the upper zone 14*a*.

The second flow passage can be established by lowering, orienting, and actuating a conventional perforator to form a set of new upper perforations (not shown) through the sleeve 20*a*, casing 11*a*, gravel pack 19, and out into zone 14*a*, similarly as disclosed above. Unfortunately, however, perforations of the type formed with conventional perforators have "burrs" or jagged projection around their perimeters where they exit the outer surface of sleeve 20*a*. Due to the required small tolerance between the outer diameter of sleeve 20*a* and the inner diameter of liner 18, these projections may, in many instances, prevent the sleeve from being readily removed from the liner after the fracturing operation has been completed. Accordingly, if it is anticipated that there may be problems in removing sleeve 20*a* from the liner after perforating the sleeve within the liner, it is preferred that sleeve 20*a* be made of a material, e.g. aluminum, which can be effectively dissolved with an acid or the like, if this becomes necessary.

Further, to avoid binding between sleeve 20*a* and liner 18 due to these projections, it is preferred to establish the required second flow passage by cutting or forming the notches 37*a* adjacent upper zone 14*a* with an abrasive jet cutting tool or preferably with a chemical cutting tool 50 (FIG. 4) of the type commercially available from Halliburton, Houston, Tex. Tool 50 is lowered on coiled tubing 51 or the like and is oriented to cut diametrically-opposed notches 37*a* through sleeve 20*a*, casing 11*a*, gravel pack, and out into zone 14*a* in the direction of the fracture plane of zone 14*a*, as will be understood in the art. Again, it is preferred for notch 37*a* to extend out into zone 14*a* for a distance equal to at least 1.5 times the diameter of wellbore 10*a* in order to penetrate the inherent "stress cage" area around the wellbore.

Once sleeve 20*a* has been perforated or notched, the lower portion of the wellbore is filled with sand 35 or the like to block flow through the sets of lower perforations 15, 27*a*, similarly as described above. A flowstring (e.g 30) is then lowered, the packer (e.g. 31) is set, and a fracturing slurry is flowed through notches 37*a* to initiate and expand fracture 41*a* in upper zone 14*a*. Again, the slurry should include a consolidating agent to consolidate gravel 19 as the slurry flows therethrough to prevent the gravel from flowing into wellbore 10*a* through notches 37*a* once the well is put back on production.

While specific embodiments have been described, it should be recognized that certain steps can be interchanged without departing from the spirit of the present invention. For example, the present invention can be carried out in a well having an open hole completion through the production zones 13*a*, 14*a*; i.e. there would be no slotted liner 18 in FIGS. 3 and 4. In this type completion, a sleeve having an outer diameter equal to at least 80% of the outer diameter of the wellbore would be positioned in the open hole and zones 13*a*, 14*a* would be fractured as described above.

Likewise, sleeve 20 could be extended all the way to the bottom of casing 11 in FIGS. 1 and 2 and could then be perforated or notched adjacent both the lower and upper zones to carry out the fracturing of the zones. Also, in any or all of the embodiments, the respective flow passages between the casing and the upper and/or lower zones can be established by using either perforators or jet or chemical cutters; although perforations are normally more economical. Other embodiments may suggest themselves to those skilled in the art without departing from the present invention.

What is claimed is:

1. A method for fracturing a lower and at least one upper subterranean zone in a wellbore, said method comprising:

lowering a sleeve in said wellbore to block flow to said at least one upper zone;

establishing a first flow passage to said lower zone;

fracturing said lower zone through said first flow passage;

establishing a second flow passage to said at least one upper zone;

blocking flow through said first flow passage after said lower zone has been fractured; and fracturing said at least one upper zone through said second flow passage.

2. The method of claim 1 including:

removing said sleeve from said wellbore after all of said subterranean zones have been fractured.

3. The method of claim 1 wherein the step of establishing said first flow passage to said lower zone comprises:

positioning said sleeve so that the lower end of said sleeve lies above said lower zone when in a first operable position within said wellbore.

4. The method of claim 1 wherein the step of establishing said second flow passage to said at least one upper zone comprises:

repositioning said sleeve so that the lower end of said sleeve lies above said at least one upper zone when in a second operable position within said wellbore.

5. The method of claim 1 wherein the step of establishing said second flow passage to said at least one upper zone comprises:

retrieving said sleeve from said wellbore;

shortening the length of said sleeve so that the lower end of said sleeve will lie above said at least one upper zone when said sleeve is in a second operable position within said wellbore; and lowering said shortened sleeve to said second operable position within said wellbore.

6. The method of claim 1 wherein the step of establishing said second flow passage to said at least one upper zone comprises:

providing a notch through said sleeve adjacent said at least one upper zone.

7. The method of claim 6 wherein said notch is formed by a downhole chemical cutter.

8. The method of claim 1 wherein the step of establishing said second flow passage to said at least one upper zone comprises:

perforating said sleeve adjacent said at least upper one zone.

9. The method of claim 1 wherein the step of blocking flow through said first flow passage comprises:

placing a column of loose, particulate material in said wellbore which extends above said first flow passage.

10. The method of claim 9 including:

removing said sleeve from said wellbore after all of said subterranean zones have been fractured; and removing said column of particulate material from said wellbore after said at least one tipper zone has been fractured.

11. The method of claim 1 wherein said method is carried out in a cased wellbore.

12. The method of claim 1 wherein said method is carried out in an open-hole wellbore.

13. The method of claim 1 wherein said method is carried out in a gravel-packed wellbore.

14. The method of claim 11 wherein the outer diameter of said sleeve is at least 80% of the inner diameter of said cased wellbore.

15. The method of claim 12 wherein the outer diameter of said sleeve is at least 80% of the inner diameter of said open-hole wellbore.

16. The method of claim 13 wherein the outer diameter of said sleeve is at least 80% of the inner diameter of said gravel-packed wellbore.

* * * * *